United States Patent [19]

McDill

[11] Patent Number: 4,459,448

[45] Date of Patent: Jul. 10, 1984

[54] DOUBLE PULL DOUBLE THROW SWITCH

[76] Inventor: Glenn A. McDill, 122 Belmont Rd., Rochester, N.Y. 14612

[21] Appl. No.: 439,022

[22] Filed: Nov. 4, 1982

[51] Int. Cl.[3] ..... H01H 9/16; H01H 3/00

[52] U.S. Cl. ..... 200/311; 200/314; 200/153 LA; 200/68.1

[58] Field of Search ..... 200/310, 311, 313, 314, 200/317, 67 G, 68, 153 L, 153 LA, 153 J

[56] References Cited

U.S. PATENT DOCUMENTS

| | | | |
|---|---|---|---|
| 2,978,555 | 4/1961 | Jones | 200/67 G |
| 3,225,170 | 12/1965 | Chabala et al. | 200/311 X |
| 3,403,236 | 9/1968 | Zoludow | 200/68 |
| 3,639,714 | 2/1972 | Fyimoto et al. | 200/153 J |
| 3,895,204 | 7/1975 | Lewis | 200/311 X |
| 4,044,214 | 8/1977 | Rayburn et al. | 200/311 X |
| 4,259,559 | 3/1981 | Kondo et al. | 200/311 |
| 4,371,759 | 2/1983 | Clark, Jr. | 200/159 A X |

FOREIGN PATENT DOCUMENTS

| | | | |
|---|---|---|---|
| 2209940 | 9/1972 | Fed. Rep. of Germany | 200/67 G |
| 1400583 | 6/1966 | France | 200/314 |
| 0229758 | 11/1943 | Switzerland | 200/311 |

*Primary Examiner*—Stephen Marcus

*Assistant Examiner*—Ernest G. Cusick

*Attorney, Agent, or Firm*—Shlesinger, Fitzsimmons & Shlesinger

[57] ABSTRACT

The switch includes a housing having a translucent sleeve of one color projecting from one end thereof. A translucent pushbutton of a different color is reciprocable in the sleeve against the resistance of a compression spring between an OFF position in which it projects from the sleeve, and an ON position in which it is located entirely within the sleeve. A bulb on the inner end of the pushbutton is disposed to be connected through the spring to a power supply, and when energized illuminates the pushbutton so that when the latter is in its outer or OFF position it emits light of said different color, but when in its inner transmits light comprising a combination of two different colors of the pushbutton and sleeve, respectively. Switch operating cams which project from the pushbutton into the housing have sliding engagement with toggle switch blades, which are mounted to pivot about stationary fulcrums between switch opening and closing positions. The pushbutton is held releasably in each of its two positions by a coiled spring that surrounds the sleeve and projects at one end through the sleeve and into a cam track formed on the outer peripheral surface of the pushbutton.

9 Claims, 4 Drawing Figures

FIG. 1
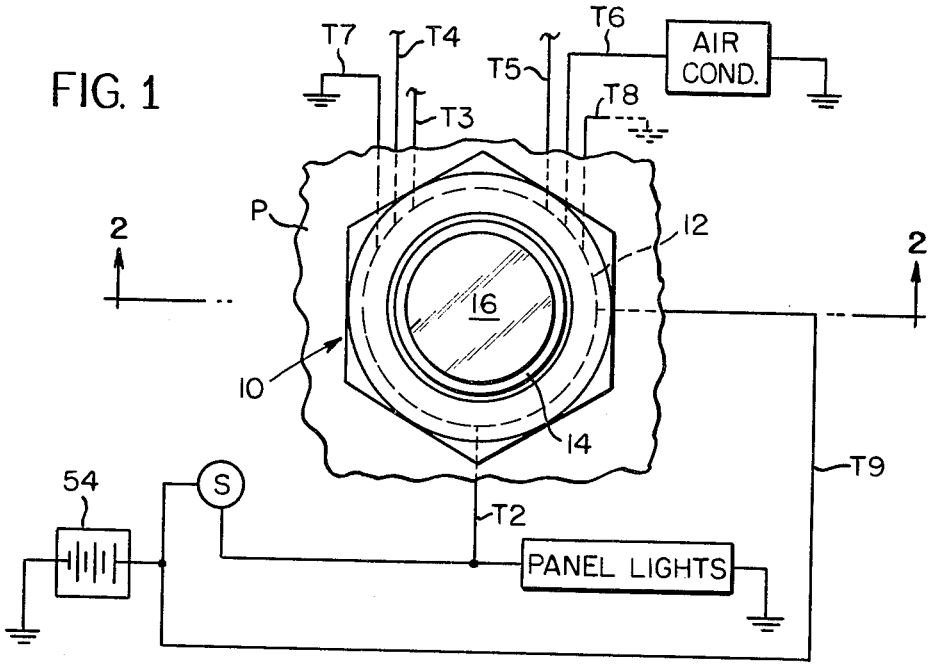
FIG. 2
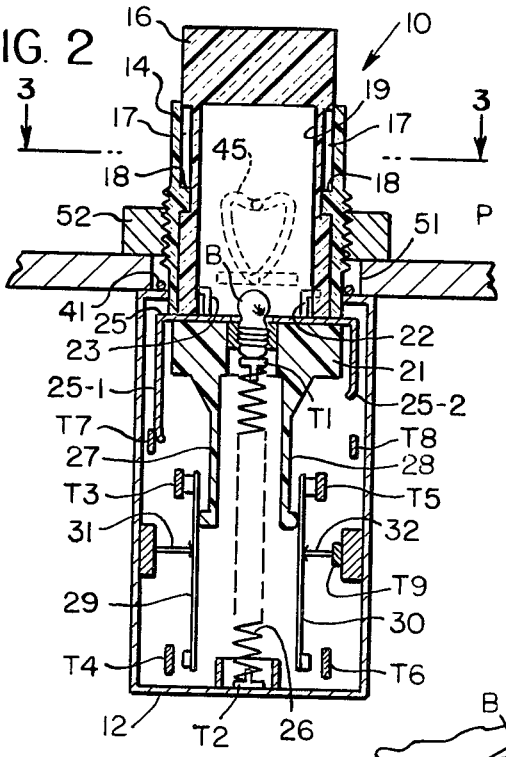
FIG. 4
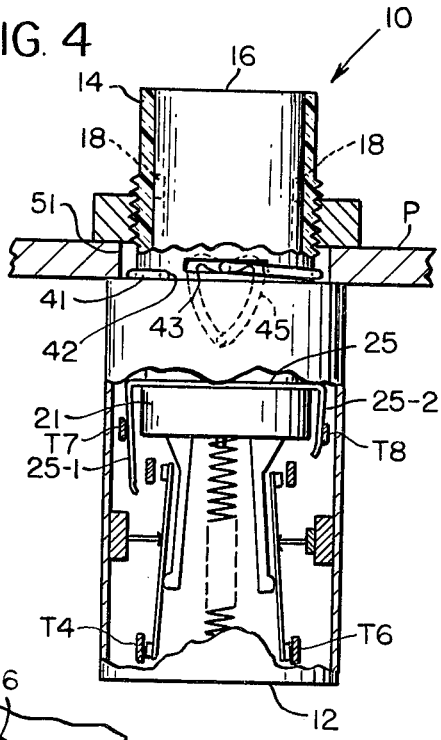
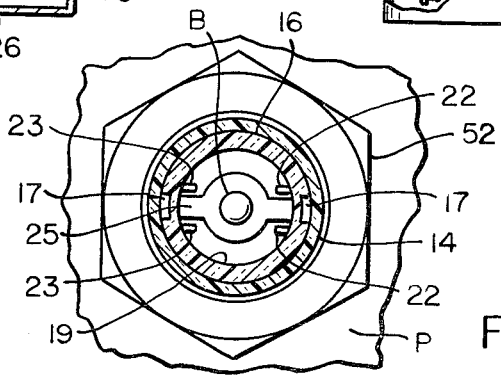
FIG. 3

DOUBLE PULL DOUBLE THROW SWITCH

BACKGROUND OF THE INVENTION

This invention relates to electrical switches, and more particularly to an improved pushbutton-type switch particularly suited for use on the dashboard of automotive vehicles and the like. Even more particularly, this invention relates to an illuminated pushbutton switch which, in one position transmits a light of one color, and in the second position transmits a light of a different color.

One of the more obvious difficulties encountered while driving an automobile in the darkness is the proper selection of switches, such as for example those used for controlling the windshield wipers, the heater, the headlights, the air conditioner, and various other electrically-operated accessories. Unless the switches are properly illuminated the operator of the vehicle could be distracted while fumbling or searching for a switch. One obvious solution is to illuminate the entire dashboard or panel, but this tends to result in unnecessary eye fatigue. Consequently, the preferred way is to illuminate the individual switches, thereby minimizing eye strain, but at the same time making switch selection easier.

A problem which has been encountered with illuminated switches, however, has been the difficulty to determine at a glance if a given switch is in its "ON" or "OFF" position. Although U.S. Pat. No. 2,883,652 discloses a transparent pushbutton having a translucent top enclosing a plurality of lamps of different colors, which are selectively energizable to indicate the operation of either a primary or a secondary motor, and the existance of any trouble related with a respective motor, the problem with this type of switch is that it requires a plurality of differently-colored bulbs to represent different conditions of operation of the associated circuits, and as a consequence the switch is extremely expensive to manufacture and difficult to install.

U.S. Pat. No. 2,194,241 discloses a pivotal mercury switch containing gases which glow with two different colors to indicate, respectively, two different conditions of the associated circuit. This type of switch, however, is extremely expensive and impractical for use on automobile dashboards.

U.S. Pat. No. 3,729,607 discloses coaxially disposed pushbuttons which display a single color, when their outer ends are disposed in coplanar registry, but which display two colors when the inner pushbutton is extended. This switch, however, does not utilize an electrically-operated lamp for illuminating the switch in either of its positions. U.S. Pat. No. 2,956,446 discloses an illuminated pushbutton switch, but it does not transmit two different colors of light to represent, respectively, two different positions of the switch. U.S. Pat. No. 3,260,830, discloses a rotatable switch the head of which transmits light of differently colored hues depending upon the position of the switch, but it is not a two-position pushbutton.

It is an object of this invention, therefore, to provide a pushbutton-type switch, which can be illuminated to emit one color of light representing the disposition of the switch in one of its two positions, and which transmits a different color of light when the switch is in a second position.

It is an object of this invention also to provide an improved, illuminated pushbutton switch which comprises a plurality of pairs of contacts for controlling a plurality of separate circuits, and novel switch operating elements that prolong the useful life of the switch as compared to prior such switches.

SUMMARY OF THE INVENTION

The switch comprises a housing having a plastic, translucent sleeve projecting from one end thereof, and adapted to be secured intermediate its ends in an opening in the panel or dashboard of an automotive vehicle, for example, so that the sleeve projects from the face of the panel. A plastic, translucent pushbutton, which has a color different from that of the sleeve, reciprocates coaxially in the sleeve between an OFF position in which it projects out of the outer end of the sleeve, and an ON position in which it is releasably held in the sleeve with its outer end disposed in coplanar registry with the outer end of the sleeve.

A light bulb in the housing is adapted to be connected in series with the switch that operates the automobile lights, so that whenever these lights are turned on the bulb will be illuminated. At such time, and assuming the pushbutton is colored red and the sleeve blue, then the former will transmit a red light when it is in its outer or OFF position, but will transmit a purple light when it is in its inner or ON position, wherein light from the bulb will pass through both the red and the blue colored sections of the pushbutton and surrounding sleeve.

In addition, the pushbutton has projecting from its inner end two, spaced, longitudinally projecting switch-operating cams which slide with the button between first and second positions of rest, in one of which each cam closes a first pair of switch contacts and in the other of which each cam closes a second pair of switch contacts. These contacts are controlled by switch blades or conductors which are supported intermediate their ends to pivot about spaced fulcrums, which are designed to minimize the stress imparted to the switch contacts and to prolong the life of the switch.

THE DRAWINGS

FIG. 1 is a fragmentary plan view of a panel having mounted thereon an illuminated pushbutton switch made according to one embodiment of this invention;

FIG. 2 is a fragmentary sectional view taken generally along the line 2—2 in FIG. 1 looking in the direction of the arrows, and illustrating the plunger or pushbutton section of the switch in its outer or OFF position;

FIG. 3 is a fragmentary sectional view taken generally along the line 3—3 in FIG. 2 looking in the direction of the arrows; and FIG. 4 is a view similar to FIG. 2, but showing the switch in its ON position and portions thereof in full for purposes of illustration.

DETAILED DESCRIPTION OF THE PREFERRED EMBODIMENTS

Referring now to the drawings by numerals of reference, 10 denotes generally a pushbutton switch comprising a cylindrical housing 12 having secured coaxially in one end thereof (the upper end in FIG. 2) one end of a rigid sleeve 14, which in the embodiment illustrated may be made of plastic, translucent material having a predetermined color. Mounted for limited reciprocable movement in the bore of sleeve 14 coaxially thereof is a cylindrical plunger or pushbutton element 16, which has an outside diameter just slightly less than the inside diameter of sleeve 14, and which likewise may be made from a plastic, translucent material. Intermediate its ends element 16 has formed in its outer peripheral surface a pair of diametrally opposed, axially extending grooves 17, which register with a pair of diametrally opposed lugs or tongues 18 that are formed on the inner peripheral surface of sleeve 14 for sliding engagement in the grooves 17. These tongue and groove connections 17, 18 permit the pushbutton 16 to be reciprocated axially in sleeve 14 between first and second positions of rest, as described hereinafter, and at the same time prevent any undesirable rotation of the pushbutton relative to sleeve 14.

Pushbutton element 16 has in its inner end (FIG. 2) a relatively large, axially-extending blind bore 19, the closed inner end of which registers with the outer end of sleeve 14, when the element 16 is in the position as shown in FIG. 2. The annular wall portion of element 16, which surrounds the bore 19, is rendered opaque by any conventional means, so that light cannot be transmitted radially through this annular wall section. However, the remaining portion of element 16 (i.e. the projecting head portion in FIG. 2) is light transmissive and is of a color different from that of sleeve 14.

The lower end of bore 19 in element 16 is closed by an annular switch actuator 21, which is attached coaxially to the bottom of element 16 by two pairs of opposed, laterally spaced, right-angular lugs or detents 22 and 23, respectively, which project from the upper surface of actuator 21 into bore 19 where projections thereon are seated in registering notches or recesses formed in the bore wall. Secured to the upper surface of actuator 21 to extend diametrally thereof through the spaces between lugs 22 and 23 is a metal ground plate 25, opposite ends of which are bent or otherwise curved at right angles downwardly over the outer peripheral surface of the actuator to form contacts 25-1 and 25-2, respectively, which extend downwardly into housing 12 for purposes noted hereinafter.

A conventional bulb B is releasably threaded into a central opening in the ground plate 25, and extends coaxially into a conventional receptacle or socket which is formed in the bore of actuator 21, and in such manner that the lower end of the bulb is engaged with a stationary, metal terminal T1, which is fastened in actuator 21 adjacent its lower end. Terminal T1 is also fastened to the upper end of an elongate, metal compression spring 26, the lower end of which is fastened to another stationary terminal T2 that is secured in any conventional manner in the lower end of housing 12 substantially centrally thereof.

Integral with and projecting from the underside of actuator 21 adjacent sides of its axial bore are two, rigid, elongate legs or switch camming elements 27 and 28, the lower ends of which are engaged with pivotal toggle members or switch blades 29 and 30, respectively. Blades 29 and 30 are mounted intermediate their ends to pivot in conventional manner on stationary fulcrums 31 and 32, respectively, which are secured to and project from the inner peripheral surface of housing 12 adjacent diametrally opposite sides thereof. Blade 29 has on opposite ends thereof conventional switch contacts that are selectively engageable, as noted hereinafter, with a pair of spaced stationary terminals T3 and T4 in housing 12, while the blade 30 has on opposite ends thereof similar contacts selectively engagable with spaced terminals T5 and T6, which are also mounted in housing 12 adjacent the side thereof opposite to terminals T3 and T4.

Two further terminals T7 and T8 are also mounted in housing 12 for engagement with the ground plate contacts 25-1 and 25-2, as noted hereinafter; and a still further terminal T9 is secured in housing 12 to supply power through the fulcrum 32 to the switch blade 30, also as noted hereinafter.

To retain the pushbutton element 16 selectively in one of two different positions, a coiled wire spring 41 surrounds the lower end of the sleeve 14, and has one end thereof secured as at 42 in sleeve 14, and has its opposite end extending through a slot 43 in the annular wall of sleeve 14, and into a camming groove 45 (FIG. 4) which is formed in the outer peripheral surface of the pushbutton element 16. This groove, which is also shown in phantom by broken lines at 45 in FIG. 2, is shaped somewhat in the form of a heart, and has the bottom and sidewalls thereof shaped in a conventional manner so as to permit the end of the spring 41, which projects through the slot 43, releasably to seat in one of two different positions of rest in groove 45, thereby to hold the plunger 16 against the resistance of the compression spring 26 in either its extended position as shown in FIG. 2, or in a retracted or innermost position as shown in FIG. 4, wherein the outer end of element 16 is releasably held in coplanar relation to the outer end of sleeve 14.

Since the configuration of camming groove 45 is conventional, it will not be described in further detail herein. However, it should be noted that when plunger element 16 is in its innermost position, it is released by first pushing slightly inwardly on element 16 to disengage the latching end of spring 41 from its position of rest in track 45, which is so shaped that upon subsequent release of element 16 it will be urged axially outwardly in sleeve 14 by spring 26 to its outermost position as shown in FIG. 2, during which movement the inner or latching end of spring 41 will slide in track 45 until the innermost end of the track registers with the latching end of spring 41. Conversely, when element 16 is pushed inwardly from its outermost position, the latching end of spring 41 is automatically disengaged from its position of rest in track 45 and follows the track once again to secure the elements 16 in its innermost or retracted position.

In use, switch 10 is adapted to be secured in an opening 51 in the panel P of an automobile dashboard or the like by means of a nut 52, which is secured onto an externally threaded portion of the sleeve 14 in order to draw the adjacent end of the housing 12 against the back of the panel as shown for example in FIG. 2. The switch terminals T2 through T9, which are insulated in a conventional manner from housing 12, can then be connected in circuit in a variety of different ways with the automobile battery 54 (FIG. 1) in order to perform certain desired functions. If it is desired that the bulb B be illuminated whenever the vehicle's panel lights are turned on, terminal T2 will be connected in series with the panel lights control switch S and the positive side of the battery 54, while terminal T7, which is always in engagement with the ground plate contact 25-1 regardless of the position of the plunger element 16, will be connected to ground. Consequently whenever switch S is closed the bulb B will be illuminated.

Alternatively, if it is desired to have the bulb B illuminated only when the plunger 16 is moved inwardly to its innermost position, then the ground contact 25-2 will be connected to ground rather than contact 25-1, so that the bulb B will be illuminated only when the switch S is closed and button 16 is in its inner or ON position.

Also, the terminal T9 may be connected directly to the positive terminal of the battery 54 to enable the switch blade 30 to control an electrically operated accessory, such as for example the vehicle's air conditioning unit. In such case terminal T6 would be connected to the motor for driving the compressor for the air conditioner, and therefore would not supply power to the latter when the element 16 is in its outer position as shown in FIG. 2. However, upon movement of the element 16 from its outer to its inner position, the switch camming element 28 would cause the blade 30 to pivot from the position as shown in FIG. 2 to a circuit-closing position in which the lower end of element 28 would pass downwardly (FIG. 2) below the fulcrum 32 to cause the upper contact on blade 30 to disengage terminal T5 and to cause the lower contact to engage terminal T6, thus completing a circuit to the air conditioner.

Although not illustrated, it will be apparent also that the switch blade 29 can be connected to the battery 54 and used to operate any other electrically-operated device on the automobile in response to the reciprocation of the pushbutton element 16.

One of the primary advantages of this switch is that when the pushbutton element 16 is in its outermost or extended position as shown in FIG. 2, its translucent head portion extends beyond the outer end of the translucent sleeve 14. Thus, whenever the bulb B is illuminated, light therefrom entering the bore 19 will pass through the translucent head of the element emitting or radiating the particular color of light for which the head of element 16 has been colored or tinted, for example red. However, since the inner end or axially bored section of element 16 (the portion surrounding bore 19) cannot transmit light, no illumination is at this stage radiated outwardly through the portion of the translucent sleeve 14 which at this stage is surrounding the opaque section of plunger 16. Consequently only red light will be emitted from the projecting head portion of the plunger 16 at this particular stage of its operation.

However, when the plunger element 16 is pushed inwardly to its retracted or ON position, the opaque portion of element 16 is shifted downwardly in the bore of sleeve 14 and out of registry with the outer end of sleeve 14, while at the same time the light transmitting portion of plunger 16 now passes into registry with the outer end of sleeve 14 so that the red light emitted from head 16 also passes radially outwardly through the surrounding sleeve 14. Assuming sleeve 14 is colored blue, the combination of the red and blue light thus emitted in this direction through sleeve 14 will appear to be purple or violet. The upper or terminal end of the head portion of the plunger 16, however, will still glow red. The result is that in one position (outer position as shown in FIG. 2), the plunger 16 will emit one color of light when the bulb B is illuminated, but when shifted to its inner position will emit radially of sleeve 14 a light having a color based upon the combination of the colors transmitted by sleeve 14 and element 16, respectively. The red light thus not only makes the switch easy to see, but also indicates the switch 10 is in its OFF position. The purple or blue light, on the other hand, indicates that the switch is ON.

Still another advantage of this invention resides in the use of the generally rigid switch camming elements 27 and 28, which are reciprocated in response to the movement of plunger 16. The advantage of using elements 27 and 28 is that by locating the fulcrums 31 and 32 in proper positions within the housing 12, it will require but a simple movement of the plunger 16 in an axial direction in order to switch or toggle the blades 29 and 30 from one to the other of their two positions. Moreover, because of the design of the camming elements 27 and 28, and the associated toggle blades 29 and 30, there is very little strain applied during use either to the camming elements or to the switch blades, thereby substantially prolonging the life of this switch as compared to prior such switches. Still another advantage of this invention is the use of the spring 26 to conduct electricity from terminal T2 through the bulb B to ground, thus making both mechanical and electrical use of spring 26.

While this invention has been described in connection with the use of specific colors for the plunger 16 and surrounding sleeve 14; and while only certain connections for the various terminals have been suggested, it will be apparent that variations in the colors and circuit connections of the terminals can be made without departing from this invention. For example, instead of the entire head of plunger 16 being light transmissive, an opaque layer could be secured over its plane, outer end, whereby it would radiate light only in a radial direction. Also, while the invention has been described as being particularly suitable for use with an automotive vehicle, it will be apparent also that it could be used in a variety of other types of circuits depending upon the particular needs of the designer. Moreover, it will be apparent that this application is intended to cover any such modifications of the invention as may fall within the scope of one skilled in the art or the appended claims.

I claim:

1. A pushbutton switch, comprising a housing having a light transmissive sleeve of a first color projecting from one end thereof, means for mounting said housing in a panel with said sleeve projecting from the face of the panel, a pushbutton mounted to reciprocate coaxially in the bore of said sleeve, and having on its outer end a light transmissive head section having a second color different from said first color, means for releasably securing said pushbutton selectively in a first position in which said head section thereof projects coaxially beyond the outer end of said sleeve, and a second position in which said head section is disposed within said sleeve, and means in said housing disposed to be connected to a power supply to direct light toward the inner end of said head section, whereby when said pushbutton is in said first position it radiates light solely of said second color, and when in said second position radiates light which is a combination of the color of said pushbutton and the color of the surrounding sleeve.

2. A pushbutton switch as defined in claim 1, wherein said means for directing light toward said inner end of head section comprises a light bulb mounted in said housing to direct light into an axial blind bore formed in the inner end of said pushbutton beneath said head section, and means rendering the annular wall portion of said pushbutton around said bore opaque, so that light cannot pass through said annular wall portion when said pushbutton is in said first position.

3. A pushbutton as defined in claim 2, including an annular switch actuator secured to the inner end of said pushbutton for reciprocation thereby coaxially in said housing, a pair of spaced switch operating cams projecting from the underside of said actuator into said housing, and a pair of switches mounted in said housing for pivotal movement by said cams between first and second positions, respectively.

4. A pushbutton switch as defined in claim 3, wherein each of said switches is mounted intermediate its ends to pivot about one of two stationary fulcrums mounted in said housing adjacent opposite sides of its centerline, and each of said cams in engaged with one of said switches for movement by said pushbutton in one direction to pivot said switches from their first to their second positions, and movable in the opposite direction to return said switches to their first positions.

5. A pushbutton switch as defined in claim 3, wherein a ground plate is secured to said switch actuator and is disposed to be connected to the ground side of a DC power supply, said bulb is releasably threaded through an opening in said ground plate to contact said ground plate and to have the threaded end of said bulb project into a central opening in said actuator, and a compression spring is secured at one end in said central opening for contact with the threaded in of said bulb, and extends at its opposite end axially through the center of said housing to the end thereof opposite said sleeve where said opposite end of the spring is secured to a stationary contact disposed to be connected to the positive side of said DC power supply.

6. A pushbutton switch as defined in claim 1, including cooperating tongue and groove means formed on the confronting surfaces of said pushbutton and said sleeve, respectively, and operatively guiding said pushbutton for limited axial movement in said sleeve.

7. A pushbutton switch as defined in claim 1, wherein said means for releasably securing said pushbutton selectively in said first and second positions comprises a cam track formed in the outer peripheral surface of said pushbutton, and a spring surrounding said sleeve with one end thereof secured to said sleeve and with the opposite end thereof projecting radially through a slot in said sleeve and into said cam track for movement in said track into two different positions of rest, which are axially spaced from each other a distance equal to the distance which said head section projects from said sleeve when the head section is in its first position.

8. A pushbutton switch comprising a housing having a sleeve projecting from one end thereof, a light transmissive pushbutton mounted to reciprocate between first and second positions in said sleeve, a plurality of pivotal switch blades mounted in said housing to pivot intermediate their ends about stationary fulcrums, and about axes transverse to the direction of reciprocation of said pushbutton, a plurality of elongate switch operating cams projecting from one end of said pushbutton and slidably into engagement each with a different one of said switch blades for movement from one side to the other side of an associated fulcrum each time said pushbutton is moved between its first and second positions, respectively, a bulb mounted in said housing to direct light onto said pushbutton, when energized, and means for selectively connecting said bulb to a power supply for energization thereby when said pushbutton is in each of its two positions, said sleeve being made from a translucent material, said pushbutton having an outer end portion made from a translucent material disposed to be illuminated by light from said bulb, said outer end portion projecting to an outer position beyond said sleeve, when said pushbutton is in its first position, and being disposed in an inner position within said sleeve, when said pushbutton is in its second position, and said sleeve and said outer end portion of said pushbutton being colored differently, whereby said outer end portion radiates light from said bulb of one color when in its outer position, and said sleeve radiates a light equal to a combination of the respective colors of said sleeve and said outer end portion, when said outer end portion is in its inner position.

9. A pushbutton as defined in claim 8, including a cam track formed in one of the confronting surfaces on said sleeve and said pushbutton, respectively and a resilient cam follower projecting from an opening in one of the confronting walls of said sleeve and said pushbutton, respectively, and into said cam track, said cam follower being disposed releasably to seat selectively in one of two axially spaced recesses in said cam track thereby releasably to secure said pushbutton in one of its first and second positions, respectively.

* * * * *